US012303953B2

(12) United States Patent
Durston

(10) Patent No.: US 12,303,953 B2
(45) Date of Patent: May 20, 2025

(54) ROLLING MILL

(71) Applicant: W. Durston Limited, High Wycombe (GB)

(72) Inventor: Matthew Durston, High Wycombe (GB)

(73) Assignee: W. Durston Limited, High Wycombe (GB)

( * ) Notice: Subject to any disclaimer, the term of this patent is extended or adjusted under 35 U.S.C. 154(b) by 153 days.

(21) Appl. No.: 17/925,629

(22) PCT Filed: Jul. 5, 2021

(86) PCT No.: PCT/EP2021/068551
§ 371 (c)(1),
(2) Date: Nov. 16, 2022

(87) PCT Pub. No.: WO2022/012994
PCT Pub. Date: Jan. 20, 2022

(65) Prior Publication Data

US 2023/0271237 A1 Aug. 31, 2023

(30) Foreign Application Priority Data

Jul. 16, 2020 (GB) ..... 2010974

(51) Int. Cl.

| | |
|---|---|
| ***B21B 35/12*** | (2006.01) |
| ***B21B 1/40*** | (2006.01) |
| ***B21B 31/22*** | (2006.01) |
| ***B21B 35/06*** | (2006.01) |
| ***B21B 35/14*** | (2006.01) |

(52) U.S. Cl.
CPC ..... *B21B 1/40* (2013.01); *B21B 31/22* (2013.01); *B21B 35/06* (2013.01); *B21B 35/12* (2013.01); *B21B 35/14* (2013.01)

(58) Field of Classification Search
CPC ..... B21B 35/10; B21B 35/12; B21B 35/14; B21B 35/143; B21B 31/24; B44B 5/0047; B44B 5/0061
USPC ..... 29/896.41
See application file for complete search history.

(56) References Cited

FOREIGN PATENT DOCUMENTS

| | | | | | |
|---|---|---|---|---|---|
| BE | 458227 A | | 10/2011 | | |
| CN | 205436616 U | | 8/2016 | | |
| CN | 206527161 U | | 9/2017 | | |
| FR | 538817 A | | 6/1922 | | |
| FR | 945935 A | * | 6/1922 | ..... | B21B 35/12 |
| GB | 190102 A | | 5/1923 | | |
| GB | 625557 A | * | 6/1949 | ..... | B21B 1/40 |
| GB | 628583 A | * | 8/1949 | ..... | B21B 1/40 |

* cited by examiner

*Primary Examiner* — Debra M Sullivan
(74) *Attorney, Agent, or Firm* — Smartpat PLC

(57) ABSTRACT

A hand-powered jewellery rolling mill is disclosed. The mill comprises a support frame and a pair of opposed parallel cylindrical rollers rotatably mounted to the support frame. A drive shaft is connected to at least one of the rollers for rotation thereof. A manually rotatable handle is configured for providing a drive force to the drive shaft. The handle may be connected to the drive shaft through a high-ratio gear train. The rolling mill may further comprise an input shaft, rotatable by the manually rotatable handle. The input shaft may have a worm and a worm-to-gear coupling may transfer torque from the input shaft to the drive shaft.

16 Claims, 9 Drawing Sheets

ROLLING MILL

TECHNICAL FIELD

The present invention relates to a hand-powered jewellery rolling mill.

BACKGROUND

Manual rolling mills are used by jewelers and craftspeople in the manufacture of jewellery. Such manual jewellery rolling mills comprise a pair of parallel cylindrical rollers between which precious metals such as silver and gold are passed to reshape material. The rollers may have flat or textured/patterned profiles for sheet material and/or may include recessed grooves (for example having a half-round or v-shaped profiled) for processing wire. Some mills may have a combination of profiles on different portions of the rollers (for example a plain section and a grooved wire section). Some rolling mills may have interchangeable rollers with different profiles. The spacing between the rollers is typically adjustable to allow variation in the resulting thickness of the worked material.

At least one of the rollers is turned by the user during use via a crank handle. The crank handle is manually powered by hand-turning.

SUMMARY

Known hand-powered rolling mills perform well and are widely used. However, it would be beneficial to provide an alternate or improved hand-powered rolling mill and embodiments of the invention seek to provide such a device which may, for example, have improved usability for the end user.

According to a first aspect there is provided a hand-powered jewellery rolling mill comprising a support frame and a pair of opposed parallel cylindrical rollers rotatably mounted to the support frame. A drive shaft is connected to at least one of the rollers for rotation thereof. A manually rotatable handle is configured for providing a drive force to the drive shaft. The rolling mill further comprises an input shaft, rotatable by the manually rotatable handle. The input shaft has a worm. A worm-to-gear coupling transfers torque from the input shaft to the drive shaft.

The applicants have found that the use of a worm-to-gear coupling for transferring torque provides an advantageous arrangement over existing hand-powered jewellery rolling mill configurations.

The drive shaft may be parallel to the axis of the cylindrical rollers. The drive shaft may, for example, be coaxial with one of the cylindrical rollers. A rotary coupling may be provided between the drive shaft and axle of the roller. The rotary coupling may for example be formed in opposed radial faces of the drive shaft and axle. For example, the coupling may be a tongue and groove coupling.

The input shaft may be perpendicular to the drive shaft. The input shaft may, for example, extend forward of the drive shaft relative to a feed direction of the rolling mill. The drive shaft axis may be parallel to the plane of the base of the support frame (for example it may be in a general horizontal alignment).

In contrast to existing arrangements, where a crank handle rotates about an axis parallel to the axis of the rollers, embodiments of the invention enable the handle to be repositioned. Thus, embodiments of the invention may provide an arrangement with improved ergonomics. Embodiments of the invention may also be more stable than existing arrangements as the action of rotating the handle will not create a moment that is inclined to tilt the rolling mill forward or backwards.

The input shaft may be offset below the axis of the pair of opposed generally parallel cylindrical rollers. This may further enhance the ergonomics by positioning the manually rotatable handle clear of the feed of the rollers and may increase the stability of the rolling mill in use.

The gear of the worm-to-gear coupling may be mounted on the drive shaft. As such the worm-to-gear coupling may be a direct coupling between the input shaft and the drive shaft. The worm-to-gear coupling provides a single stage reduction. Advantageously, the worm-to-gear coupling can provide a relatively high ratio reduction in a single stage. As such, in some embodiments the worm-to-gear coupling may have a reduction ratio of greater than 10 to 1, for example greater than 20 to 1. In some embodiments the reduction ratio of the worm-to-gear coupling may be between 30 to 1 and 50 to 1, for example it may have a reduction ratio of 40 to 1. Embodiments of the invention may provide a much greater mechanical advantage than a conventional manual rolling mill (which may for example have a 4 to 1 gearbox) whilst still providing a simple and reliable configuration.

The handle may be coupled directly to the input shaft.

The drive shaft may be coupled to one of the pair of opposed parallel cylindrical rollers. The rolling mill may further comprise a geared engagement between the pair of opposed parallel cylindrical rollers. For example, the manually rotatable handle may be provided proximal to a first axial end of the rollers and the rollers may be in geared engagement at the other axial end.

The rolling mill may further comprise an adjustor for setting the spacing between the rollers. The adjustor may include a control dial. The control dial may be provided at an upper portion of the support frame.

The drive shaft, the input shaft and the worm-to-gear coupling may be enclosed by a gearbox housing.

The gearbox housing may comprise a body adapted for attachment to the rolling mill. The body may for example have a base with a footprint that conforms to the external profile of one of the sides (for example an external side) of the rolling mill support frame. The gearbox housing may be removably connected to the support frame, for example by a number of through bolts. the gearbox housing may have an open box section which is closed by the side of the support frame.

The gearbox housing may comprise a drive shaft bore extending through the body in a first direction. The first direction may be perpendicular to the plane of the base of the gearbox housing. The gearbox housing may have an input shaft bore extending through the body in a second direction. The second direction may be perpendicular to the first direction. The second direction may be parallel to a sidewall of the gearbox housing. The bores may partially intersect to define a cavity for the worm-to-gear coupling.

The input shaft and drive shaft may be mounted on bearings within the gearbox housing.

The drive shaft bore may be a through bore. The gearbox housing may further comprise a cover closing the external end of the bore (which is the end of the bore distal from the frame of the rolling mill). The cover may retain the drive shaft and/or drive shaft bearings within the gearbox housing.

The input shaft bore may be a blind bore. The input shaft may extend beyond the open end of the bore to provide a stem. The manually rotatable handle may be attached to the stem. The gearbox housing may further comprise a flange surrounding the open end of the input shaft bore for receiving a bearing to support the input shaft. The input shaft may extend from a first bearing at the closed end of the input shaft bore to a second bearing proximal to the stem of the shaft. A retaining member may be connected to the housing at the open end of the input shaft bore to retain the input shaft and/or the input shaft bearing. The retaining member may have a central aperture for the stem to extend outwardly from the gearbox housing.

The gearbox housing, the drive shaft, the input shaft, the worm-to gear coupling, and the manually rotatable handle may be configured as a gearbox subassembly. As such the gearbox subassembly may be removably mounted on the frame of the rolling mill. For example, aligning and attaching the gearbox housing to the corresponding attachment points (for example bolt holes) on the rolling mill frame may position and bring into engagement the coupling between the drive shaft and roller.

The provision of a high ratio gear train may be novel and inventive in its own right. Accordingly, another aspect of the invention provides a hand-powered jewellery rolling mill comprising a support frame and a pair of opposed parallel cylindrical rollers rotatably mounted to the support frame. A drive shaft is connected to at least one of the rollers for rotation thereof. A manually rotatable handle is configured for providing a drive force to the drive shaft. The handle is connected to the drive shaft through a gear train having a ratio of greater than 10 to 1. In some embodiments the gear train may have a ratio of greater than 20 to 1.

The applicants have found that the use of a manually rotatable handle coupled through a gear train having a ratio of greater than 10 to 1 provides an advantageous configuration over existing designs. The rolling mill of embodiments may provide significant mechanical advantage in transferring torque to the rollers.

The gear train may be a multi-stage reduction gear train. In some examples the gear train may have three reduction stages. A multi-stage gear reduction may avoid the need for excessive individual gear ratios.

The gear train may comprise a plurality of compound gears. Such an arrangement may enable a particularly compact configuration for the gear train. The gear train may comprise two compound gears.

The gears of the gear train may be arranged about two parallel axis. As such the gears may be groups coaxially about the two parallel axis. The input gear may be coaxial with one compound gear. The input gear may mesh with a gear of a further compound gear. The compound gears may each have respective meshing gears. The further compound gear may be coaxial with the output gear.

In some examples the mill may further comprise an axle for supporting the input gear and compound gear. The axle may comprise a first portion for supporting the compound gear and a second portion for supporting the input gear. The second portion may have a reduced diameter. The diameter may have a step change in diameter to define a shoulder against which the input gear may be seated.

The output gear of the gear train may be coupled to the drive shaft of the upper roller. The input gear may be axially aligned with the lower roller.

The manually rotatable handle and gear train are mounted to the support frame proximal to one axial end of the rollers. The rolling mill may further comprise a drive coupling connecting the pair of rollers. The drive coupling may be mounted to the support frame proximal to the other axial end of the rollers.

According to a further aspect of the invention, there is provided a gearbox assembly for a rolling mill in accordance with an embodiment. The gear box assembly may comprise the gear train and the manually rotatable handle.

Whilst the invention has been described above, it extends to any inventive combination of the features set out above or in the following description or drawings. Unless otherwise stated, each of the integers described may be used in combination with any other integer as would be understood by the person skilled in the art.

BRIEF DESCRIPTION OF THE DRAWINGS

Embodiments of the invention may be performed in various ways, and an embodiment thereof will now be described by way of example only, reference being made to the accompanying drawings, in which.

DETAILED DESCRIPTION

In the context of embodiments of the invention references may be made to components being horizontal or vertical and it should be appreciated that such references are not intended to be limiting. Such terms are used for ease of reference and are intended to refer to the general directions relative to the apparatus when in use. For example, a "horizontal" direction or plane may, in practice, be defined by being generally parallel to the surface upon which the apparatus is mounted during use. Likewise, a "vertical" direction or plane may be defined by being generally perpendicular to the surface upon which the apparatus is mounted. As such, the relevant axis of the apparatus are not considered fixed in absolute terms (rather only relative to the underlying surface). Any other references to directions such as above/below or upward/downward are likewise intended to be interpreted in a relative, non-limiting, manner.

Figure 1:
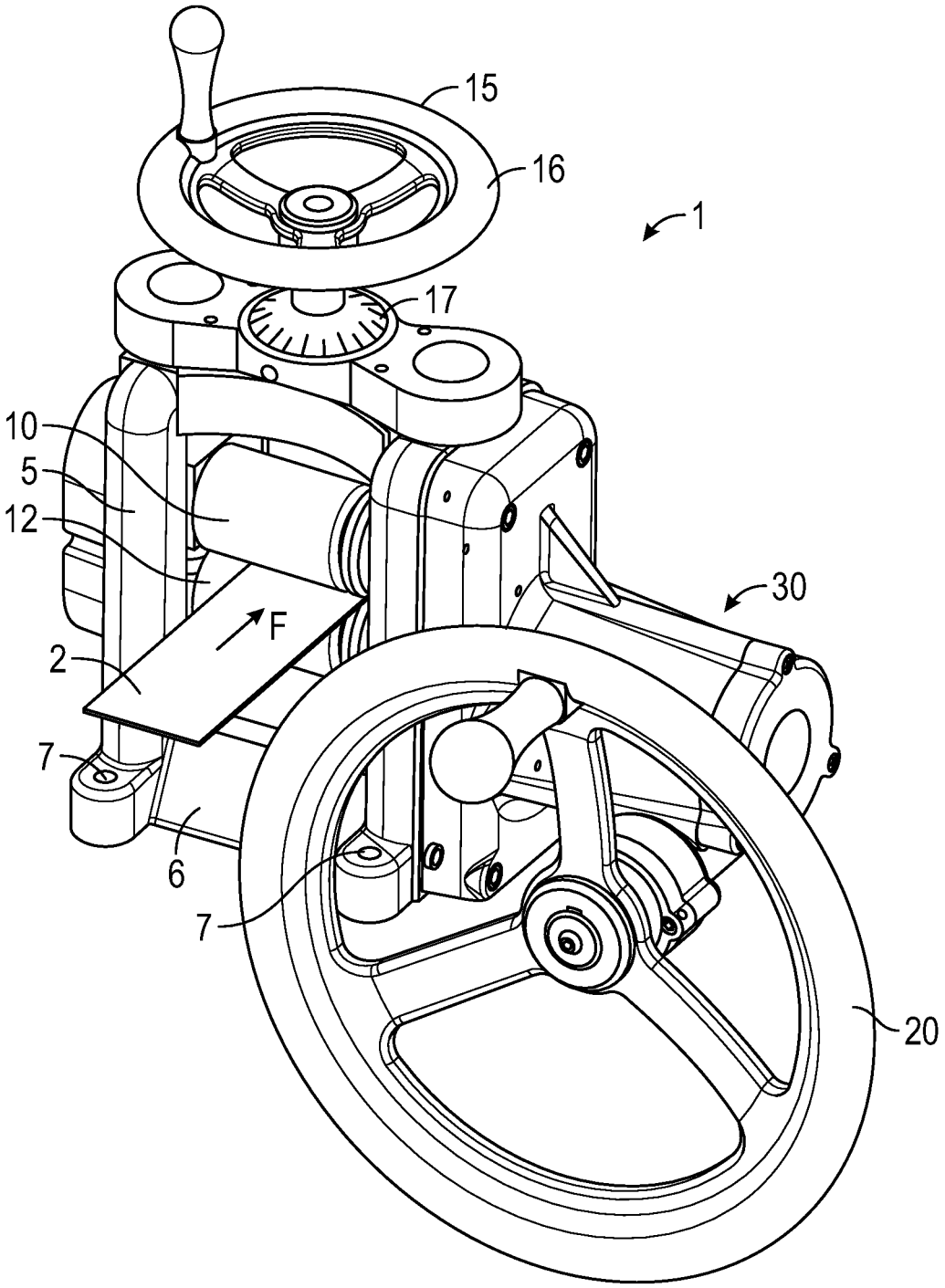
FIG. 1 shows a schematic three-dimensional view of a hand-powered jewellery rolling mill in accordance with an embodiment.
Figure 2:
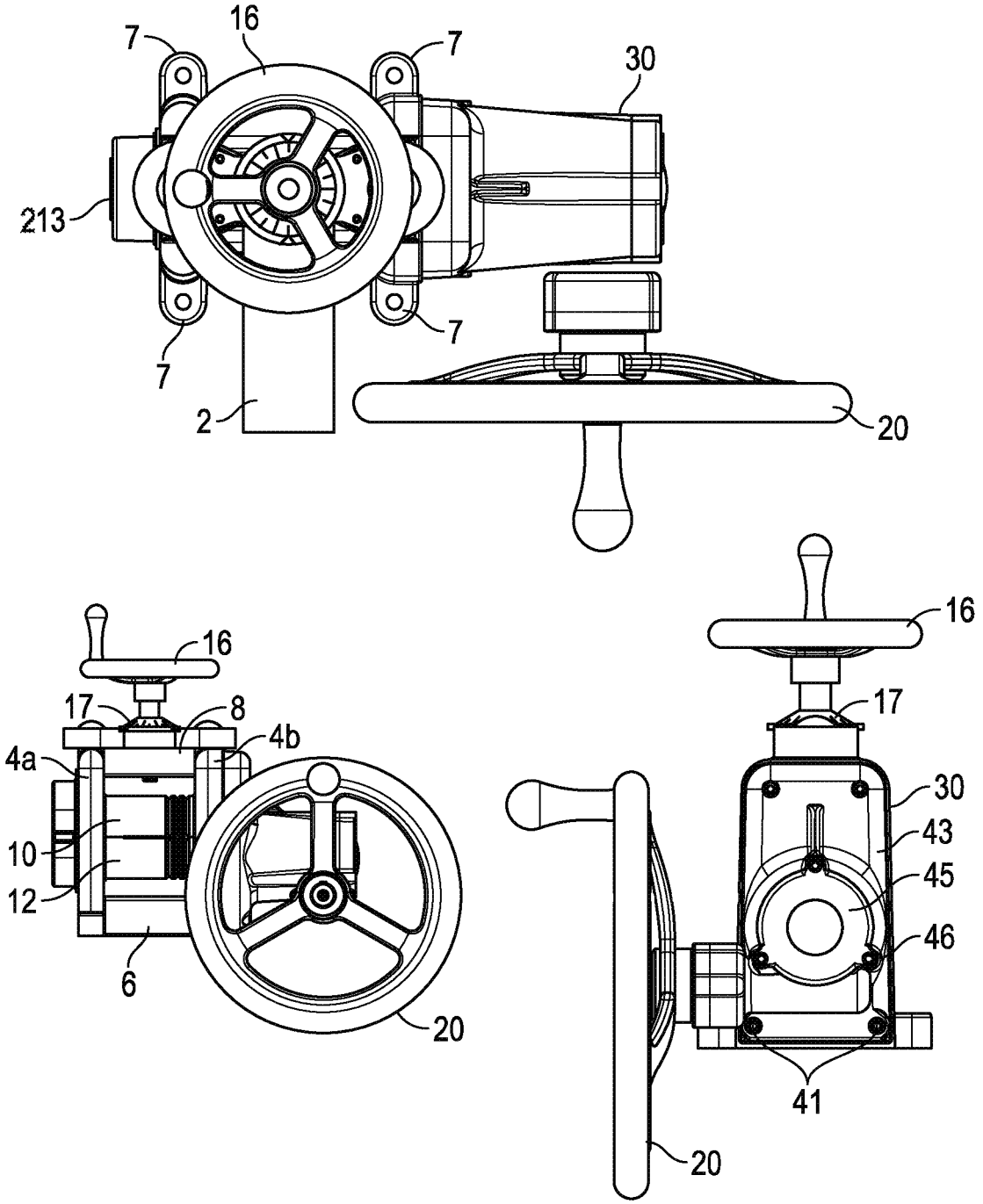
FIG. 2 shows top, front and side projections of the rolling mill of FIG. 1.

A hand-powered jewellery rolling mill 1 in accordance with an embodiment of the invention is shown in FIGS. 1 and 2. The mill 1 comprises a support frame 5, a pair of opposed parallel cylindrical rollers 10, 12 and a rotatable handle 20 for providing a drive force to the rollers 10,12. The handle includes a wheel 21 and a crank member but other configurations may be possible. In use, a workpiece of precious metal 2 (shown for reference only in the figures and not part of the apparatus) is passed between the rollers 10, 12 by actuating the rollers using the handle 20. The metal is compressed to produce a desired thickness. An adjuster 15 is provided at the upper end of the rolling mill 1 for setting the spacing between the rollers 10, 12. The adjustor includes a control dial 16 and a gauge 17. In use, a workpiece may be passed through the rolling mill several times with the spacing of the rollers 10, 12 reduced progressively using the adjustor until the final thickness is achieved. The adjustor mechanism is not shown in the figures as it is enclosed by a protective guard, but suitable arrangements would be apparent to those skilled in the art.

The frame 5 is formed from a single piece metal casting. As best seen in FIG. 2, the frame 5 comprises two spaced apart parallel upright side members 4*a*, 4*b* which extend vertically from a horizontal base portion 6. The base portion 6 is provided with bolt holes 7 at each corner to allow the rolling mill to be secured to a work bench during use. An upper joining member 8 connects the top of the side members 4*a*, 4*b* and is generally parallel to the base portion 6. The frame defines a central aperture in which the rollers 10, 12 are rotatably mounted.

The rollers 10, 12 are generally cylindrical and formed of hardened steel. Each roller 10, 12 is mounted on parallel axle extending perpendicular to the side members 4*a*, 4*b* of the side members. The feed direction of the rolling mill 1 is indicated by the arrow F on FIG. 1 and is perpendicular to the perpendicular to the axis of the rollers 10, 12 and generally parallel to the base of the frame 5 (i.e. horizontal). The rollers 10, 12 both include a first portion having a smooth cylindrical outside portion and a second portion having opposed grooves which define a shaped cross section gap (for example the grooves may each be V-shaped and jointly define a square section). The upper roller 10 is vertically adjustable relative to the lower roller 12 using the mechanism associated with the adjuster 15 such that the desired roller spacing can be set by a user. One side of the rollers 10 and 12 are engaged by a geared coupling 213 (covered by a protective cover in the figures) such that they rotate in unison. As will be known by those skilled in the art, the gears of the geared coupling 213 are configured with a tooth depth selected to ensure that they can intermesh sufficiently at a variety of spacings between the upper and lower roller. In the illustrated embodiment the geared coupling 213 is at an axial end of the rollers but it will be appreciated that in other embodiments the rollers could extend further beyond the coupling such that the coupling is in at a non-end section of the rollers/roller axles.

Figure 3:
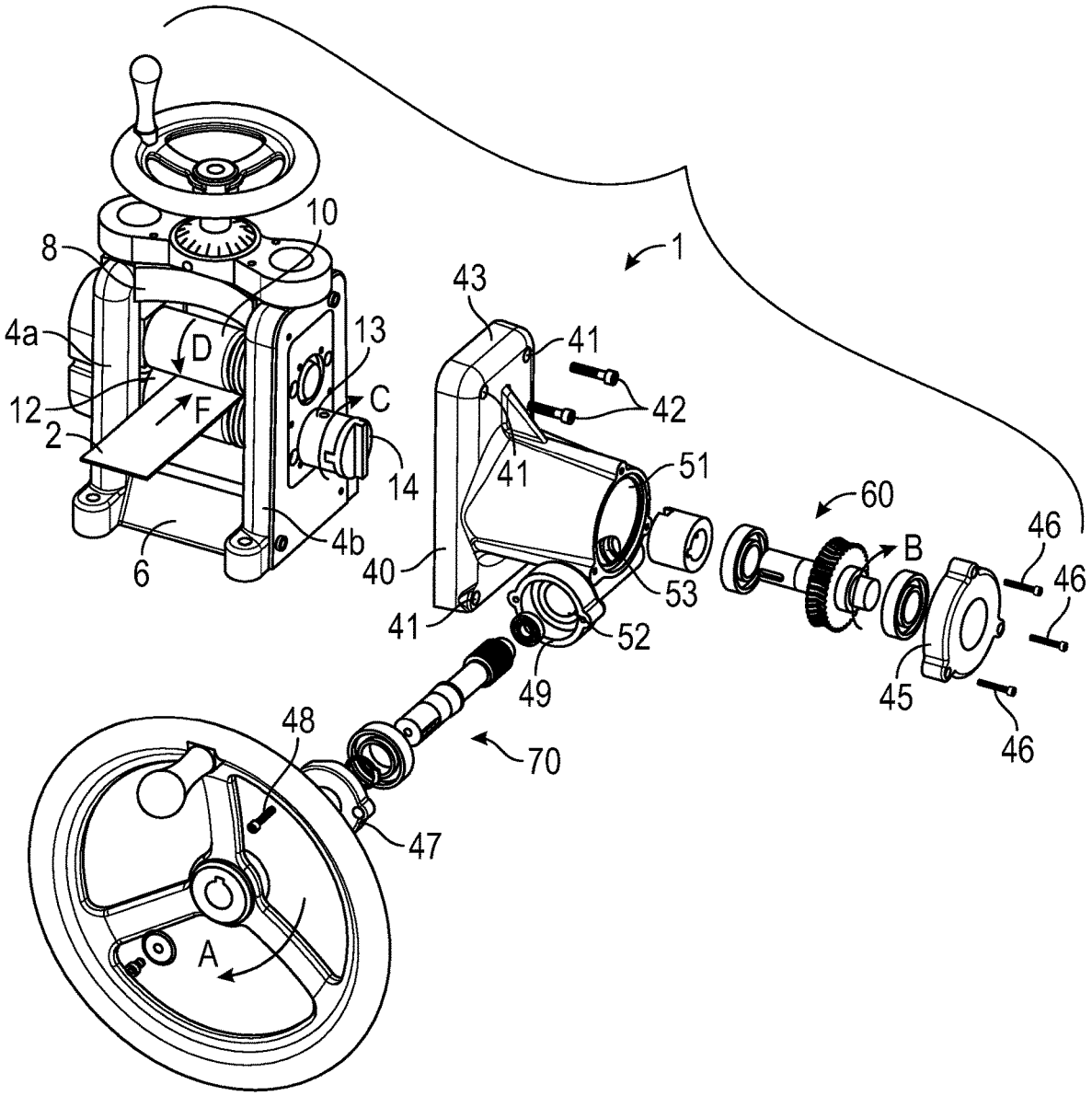
FIG. 3 is an exploded view of the rolling mill of FIG. 1.

As seen in FIG. 3, the lower roller 12 includes an axle stem 13 which extends beyond the frame 5 on the side member 4*b* opposite to the gear coupling 213. The axle stem 13 includes a coupling feature 14 in the form of a radial tongue projecting axially from the end face of the axle stem 13.

Figure 4A:
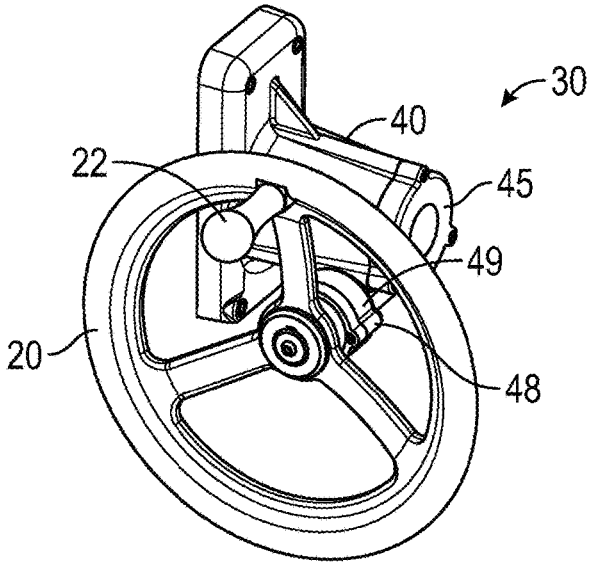
FIGS. 4A and 4B show an assembled and exploded view of the gearbox subassembly of the rolling mill of FIG. 1.

The rolling mill 1 is further provided with a gearbox subassembly 30 as shown in an exploded view with the mill in FIG. 3 and in isolation in FIGS. 4*a* (assembled) and 4*b* (exploded). The gearbox subassembly 30 is assembled around a housing 40 which is a single piece metal casting. The housing 40 has a base portion 43 which is shaped and proportioned to conform to the external side of one of the side members 4*b* of the frame 5. The housing 40 is removably attached to the side members 4*b* via bolts 42 which pass through holes 41 in the base portion 43 and into corresponding bolt holes 9 in the frame 5. A bolt 42 is provided at each corner of the base portion 43. The housing 40 encloses the axle stem 13 and when attached to the frame 5 aligns and engages a coupling member 63, mounted within the housing (as will be explained further below), with the stem 13 such that the tongue 14 is received in a corresponding groove 65 of the coupling member.

The gearbox housing 40 defines a first bore 51 which extends transversely through the entire width of the housing. The interior (i.e. side closest to the frame 5) end of the bore 51 surrounds the axle stem 13 and coupling 63 when the rolling mill 1 is fully assembled. The exterior end of the bore 51 is closed by a cap 45 attached by fasteners 46 distributed around the circumference of the cap 45.

A second bore 52 is defined in the housing 40 and extends perpendicular to the first bore 51. The second bore 51 is a blind bore having an opening at a forward end but not extending through the housing. The second bore 52 is positioned below the first bore 51. The vertical spacing between the bores 51, 52 is such that they overlap and partially intersect to define a common cavity 53 within the housing 40. The second bore 52 extends generally parallel to the plane of the base 43 of the housing 40 (and therefore to the side 4*b* of the frame). The second bore is also generally parallel to the plane of the base portion 6 of the frame 5 (and as such is generally horizontally aligned). The second bore is closed by a cap 47 which includes an aperture at its centre (which as will be explained below is for the input shaft). The cap 47 is secured to a flange 49 formed in the housing 40 around the end of the second bore 52. Fasteners 48 are provided to attach the cap 47 to the flange 49, for example diametrically opposed pair of fasteners.

Figure 4B:
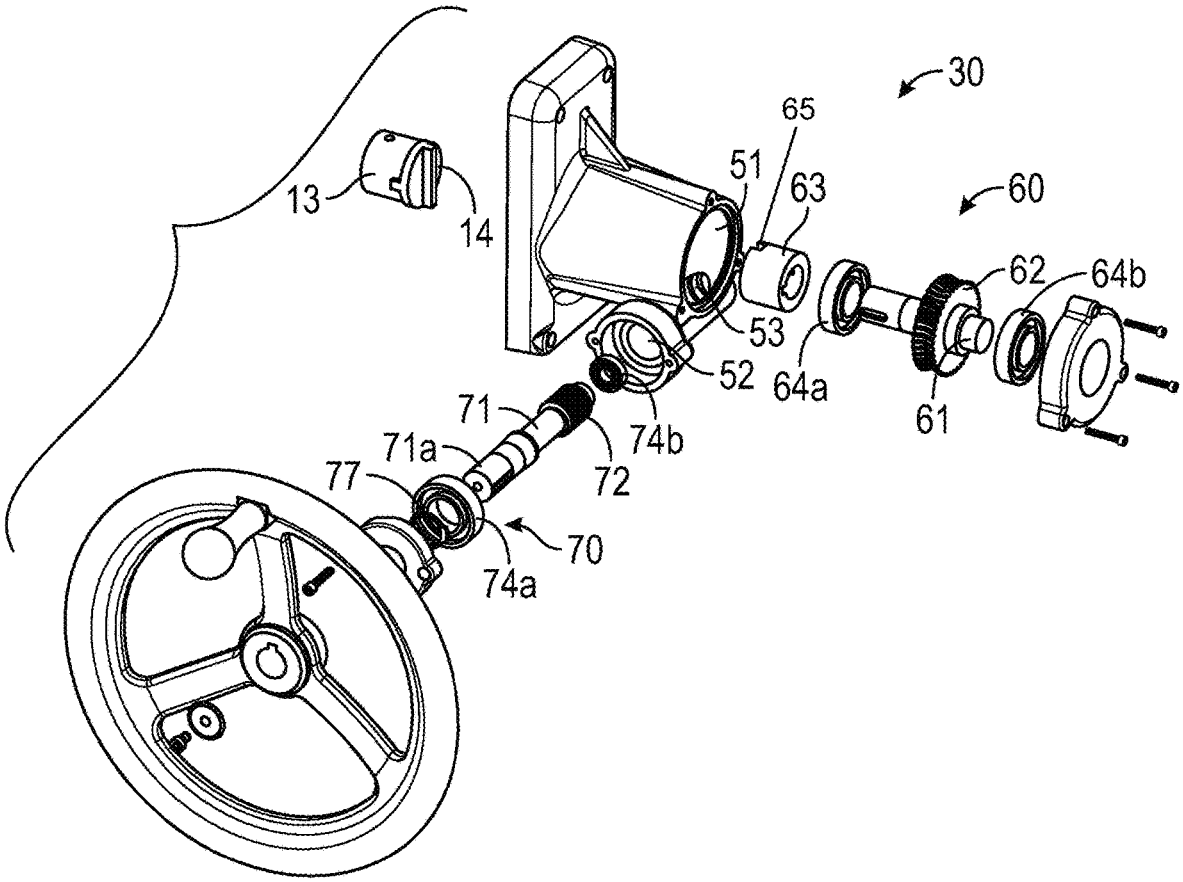

Within the housing 40 of the gearbox assembly is mounted a drive shaft assembly 60 and an input shaft assembly 70. The drive shaft assembly 60 is connected to the lower roller 12 via the coupling 63 and axle stem 13. The input shaft assembly 70 carries the rotatable handle 20 through which the user inputs torque to operate the rolling mill 1. The detailed components of each assembly will be described further below with particular reference to FIG. 4B.

The drive shaft assembly 60 comprises a drive shaft 61 on which is mounted a gear 62. The shaft is seated on a first and second bearings 64*a*, 64*b* provided on opposite sides of the gear 62. The bearings 64 rotatably mount the shaft 61 within the bore 51 of the housing 40 where it is retained by the cap 45. The inward end of the shaft 61 has a keyed profile to engage with the inner bore of the coupling 63 (which in turn engages the axle stem 13).

The input shaft assembly 70 comprises an input shaft 71 on which is mounted a worm 72. A pair of bearings 74*a*, 74*b* are provided at opposite sides of the worm 72 and rotatably mount the shaft 71 within the second bore 52 of the housing 40. The first bearing 74*a*, at the external end of the shaft 71 is seated in the flange 49 of the housing 40 which surrounds the open end of the bore 52. The second bearing 74*b* is located at the blind end of the bore 54. A retaining split ring 77 is provided to axially fix the outer bearing 74*a* relative to the shaft 71. The cover 47 retains the shaft in the housing 40. A stem 71*a* at the outer end of the shaft 71 extends through the aperture of the cover 47. The handle 20 is attached to the stem 71*a*. Thus, the handle 20 may be used to rotate the input shaft 71 and provide a motive torque to the rolling mill 1.

Figure 5:
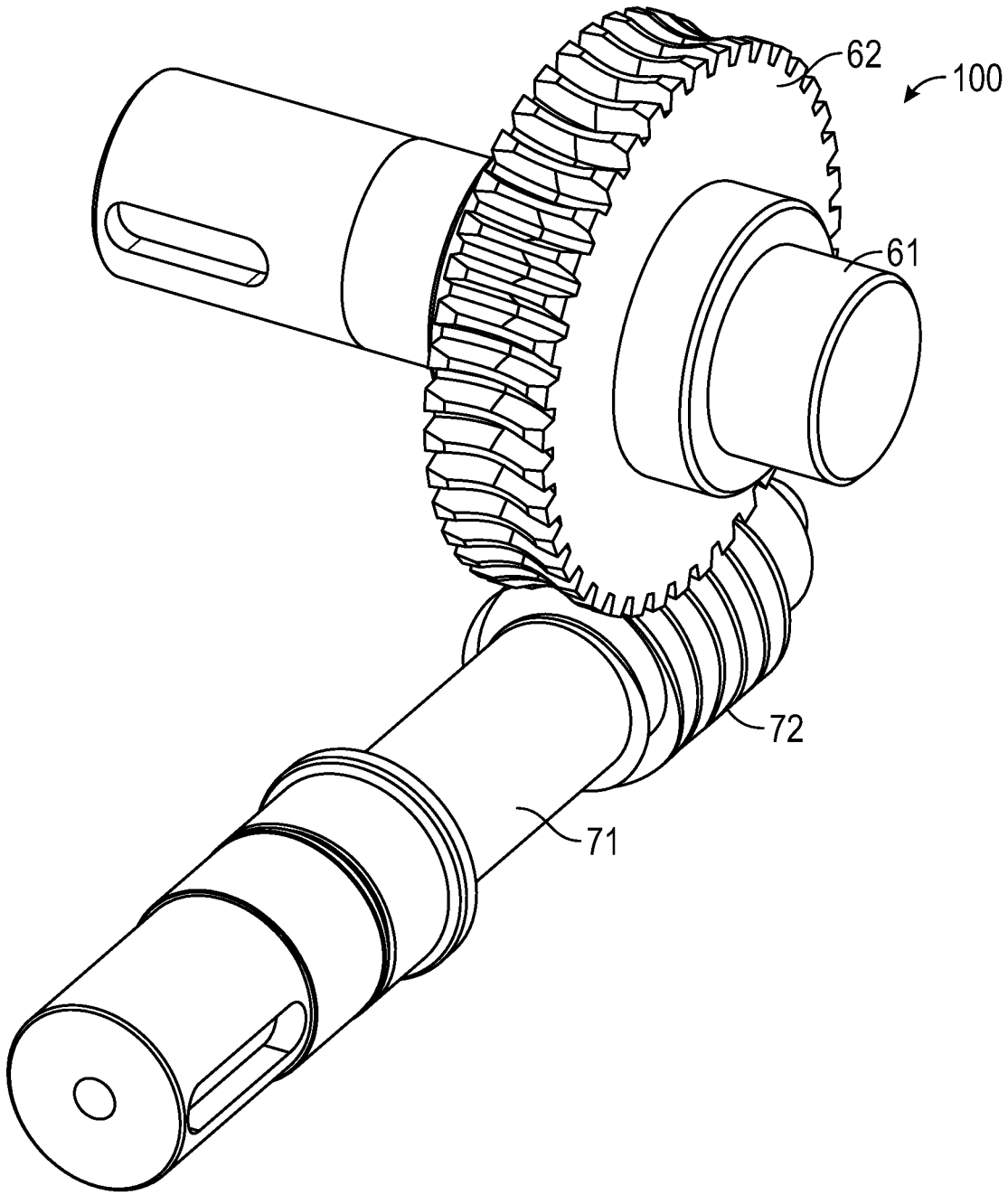
FIG. 5 shows a detailed view of the gear and shaft components of the gearbox subassembly in isolation.
Figure 6:
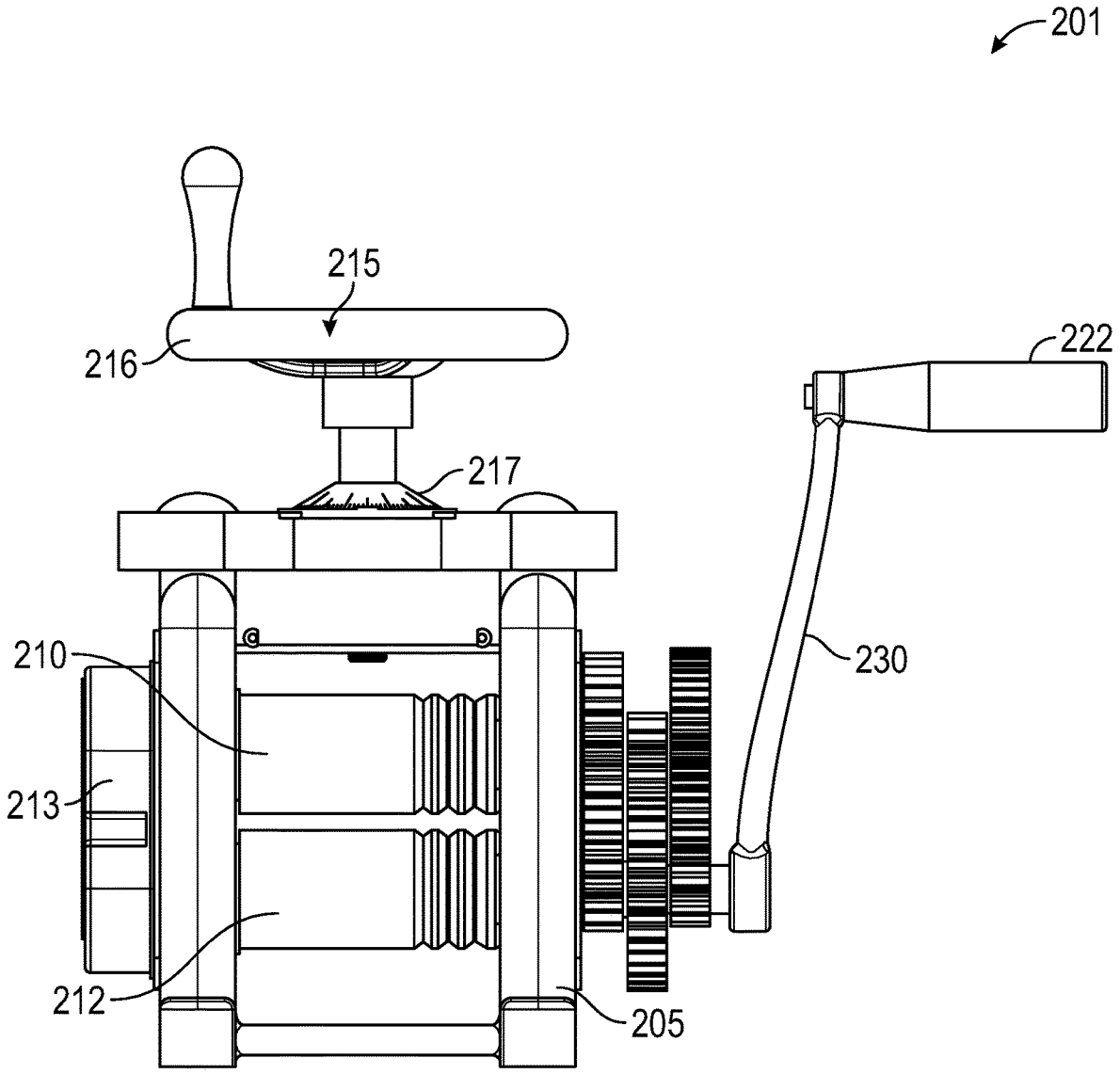
FIG. 6 shows a schematic end view of a hand-powered jewellery rolling mill in accordance with another embodiment.
Figure 7:
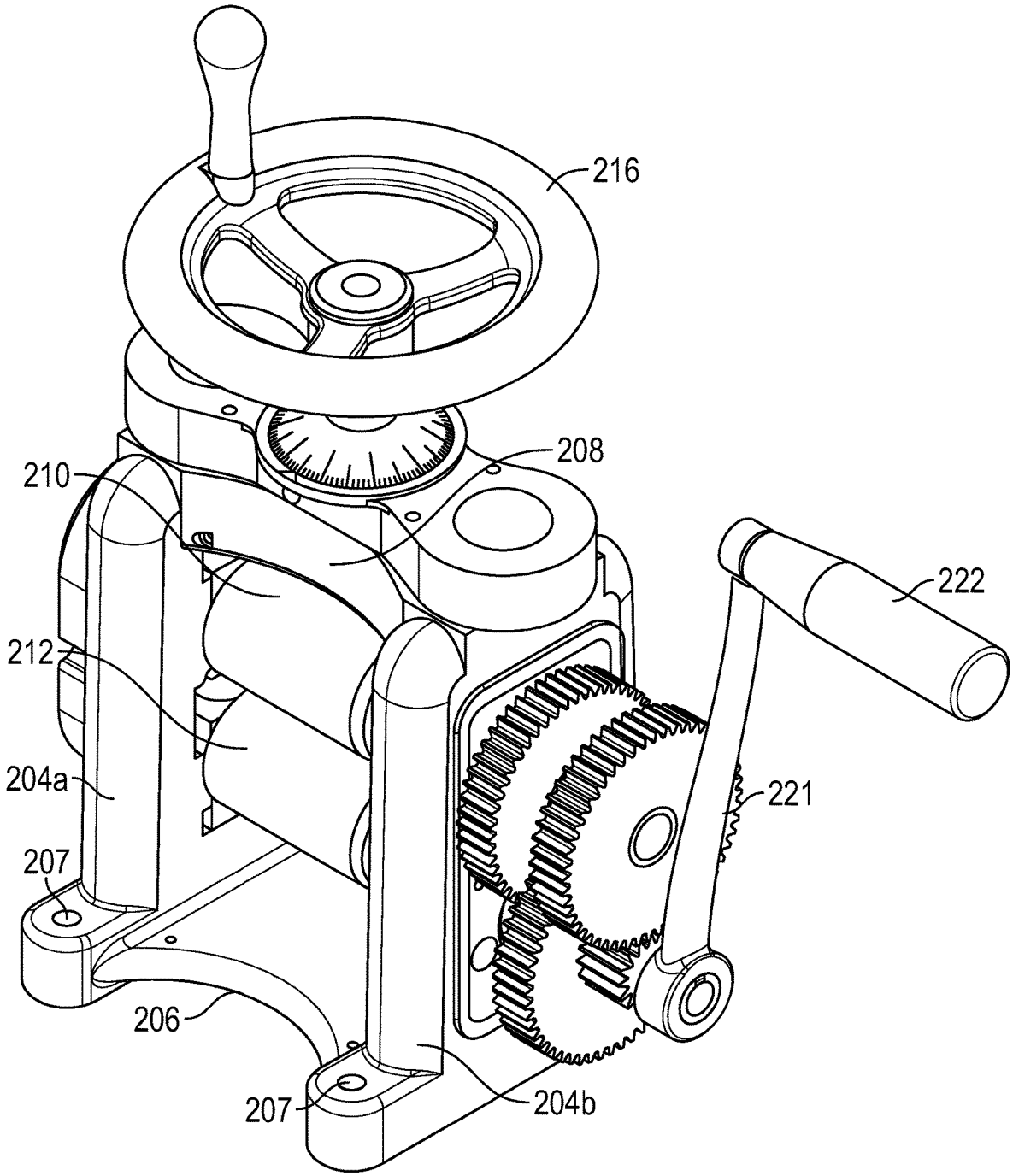
FIG. 7 shows a three-dimensional view of the rolling mill of FIG. 6.

As illustrated in the isolated view of FIG. 5, the worm 72 of the input shaft 71 and the gear 62 of the drive shaft 61 form a worm-to-gear coupling 100. It may be noted that the gear 62 has a dished profile to provide good meshing engagement with the worm 72. The worm-to-gear coupling 100 is formed in the cavity 53 at the intersection of the first bore 51 and second bore 52 of the housing 40. The worm-to-gear coupling 100 provides a relatively high gear ratio, for example a 40 to 1 ratio, in a simple single stage gear arrangement.

In use the operator rotates the manual input handle 20 as represented by Arrow A in FIG. 3. This causes a rotation of the input shaft assembly 70 on its bearings. The rotation of the worm 72 in the worm-to-gear coupling 100 causes the gear 62 to rotate the drive shaft assembly 60 as represented by arrow B. The high ratio of the worm-to-gear coupling 100 allows the user to rotate the input handle 20 at relatively high speed and with relatively low force whilst transferring a required high torque to the drive shaft 61 and rollers 12 as represented by arrow C. As the rollers 10, 12 are coupled by the gearing 213, the upper roller 10 will rotate counter to the lower roller 12, as shown by arrow D. The rotation of the rollers 10, 12 acts to draw a workpiece through the gap therebetween when it is fed into the nip of the rollers by the user in the feed direction shown by arrow F.

A hand-powered jewellery rolling mill 201, in accordance with a further embodiment, is shown in FIGS. 6 to 9. The mill 201 is of a similar basic construction to that of the first embodiment and common features will not be described in further detail below. The mill 201 generally comprises a support frame 205, a pair of opposed parallel cylindrical rollers 210, 212 and a rotatable handle 220 for providing a drive force to the rollers 210,212. The handle includes an arm 221 and a crank member 222 but other configurations may be possible.

Figure 8:
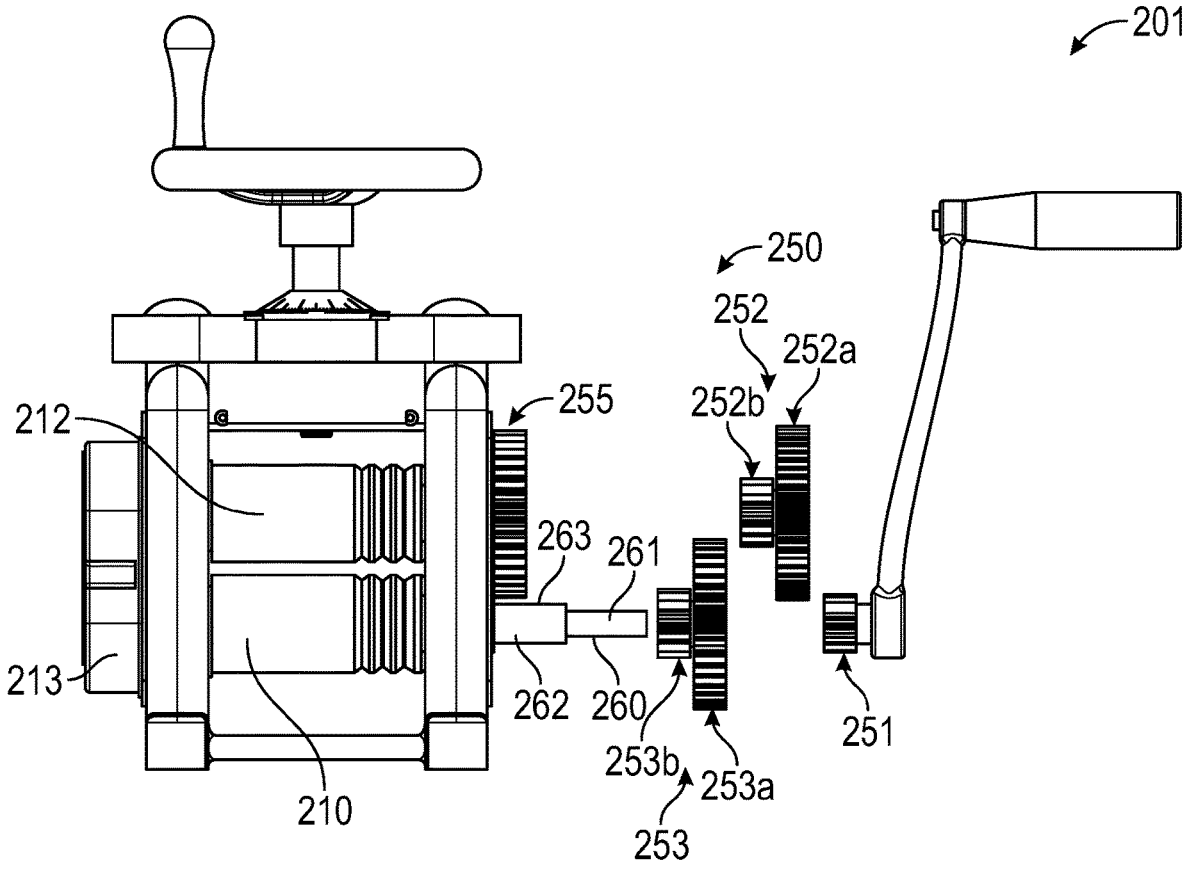
FIG. 8 shows a front view of the rolling mill of FIGS. 6 and 7 with the gear train in as an exploded detail.
Figure 9:
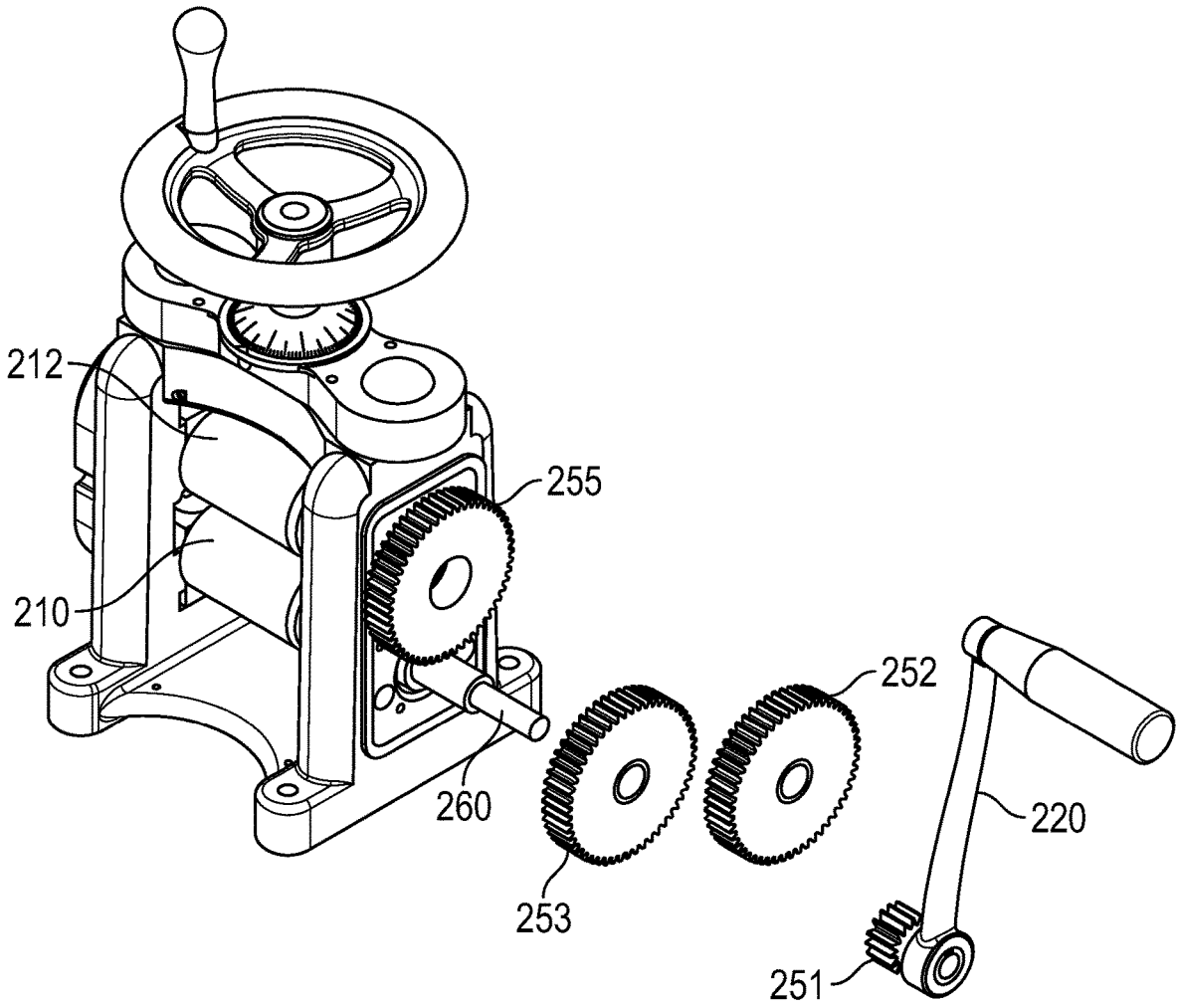
FIG. 9 shows a three-dimensional view of the rolling mill of FIGS. 6 and 7 with the gear train in as an exploded detail.

The rolling mill 201 of this embodiment is further provided with a gearbox subassembly 230 best seen in the exploded views of FIGS. 8 and 9. Typically, the gearbox subassembly would include a protective housing attached to the side of the adjacent side member 204*b* but this is omitted in the figures for clarity. The housing could for example be a single piece metal casting.

The gearbox subassembly comprises a gear train 250 which mechanically couples the handle 220 to the rollers 210, 212. As will be explained further below the gear train 250 is designed to have a high gear ratio, for example greater than 10 to 1, to provide significant mechanical advantage to the user when operating the rolling mill 1.

The gear train 250 of the example includes multiple stages with an input gear 251, first and second compound gears 252 and 253 and an output gear 255. The input gear 251 is directly coupled to handle 220 such that it is rotated with the handle and is a small gear having 15 teeth. The compound gears 252 and 253 each include a large input gear 252*a*, 253*a* respectively having 52 and 40 teeth and a smaller output gear 252*b*, 253*b* each having 16 teeth. The output gear 255 is directly coupled to the upper roller 212 such that the roller rotates with the output gear and has 40 teeth. As noted above, the upper 212 and lower 210 rollers are connected via the coupling 213 such that when the upper roller 212 is rotated via the output gear 255 the lower roller will rotate at an equal speed and in the opposite direction (to cause the rollers to pinch together at their nip).

As can be appreciated from the figures, to provide a compact gear train 250 the gears are mounted coaxially about two parallel axis. The input gear 251 and second compound gear 253 are concentrically mounted on one axis and the output gear 255 and first compound gear 252 are concentrically mounted on the other axis. The two axis generally correspond to the axis of the rollers 210 and 212. It may be appreciated that the output gear 255 and upper roller 212 are coaxial. As the axial spacing between the rollers may be adjustable the alignment between the lower roller 210 and the input gear 251 may either be configured to vary in use or the gear train may have sufficient tolerance to enable the axial spacing of the gears to vary. The axle 260 on which the input gear 251 and second compound gear 253 are mounted extends in cantilever manner outwardly from the side of the frame 204*b* of the rolling mill. The axle 260 includes a first portion 261 at the distal end for seating the input gear 251 and handle 220 and a second portion 262 at the proximal end for seating the compound gear 253. The outer portions 261 has a reduced diameter in comparison to the inner portion 262 with a flange 263 being defined between the portions against which the input gear 251 can be seated.

In use, the user rotates the handle 220 and with it the input gear 251. As will be noted the handle has a relatively long arm to provide mechanical advantage. The first reduction stage of the gear train 250 is provided between the input gear 251 (15 teeth) the input 252*a* (52 teeth) of the first compound gear 252. The second reduction stage is provided between the output gear 252*b* (16 teeth) of the first compound gear 252 and the input gear 253*a* (40 teeth) of the second input gear 253. The third (and final) reduction stage is provided between the output gear 253*b* (16 teeth) of the second compound gear 253 and the output gear 255 (40 teeth). Through these multiple stages the hear train can provide a total reduction ratio of 22 to 1.

Embodiments of the invention may provide an increased mechanical advantage over conventional rolling mills without significantly increasing the complexity of the rolling mill or gearbox. Additionally, embodiments may provide a more stable configuration that may for example be useable even without bolting to a work surface. For example, the provision of a handle which requires less force at a higher speed has been found to improve the ease of use.

Further the handle position provided by the first embodiment of the invention may also be advantageous. With a conventional rolling mill the handle may be side mounted and may rotate about an axis parallel to the roller axis, the handle may include a relatively long crank arm to provide mechanical advantage. In combination these features may limit the location where the mill can be located or used. In contrast embodiments of the invention are able to use a smaller operating handle or wheel and mount the handle at the front of the mill. This may provide a convenient arrangement where, for example, the rolling mill of an embodiment can be placed at the edge of a work bench (with the handle extending forward and over the edge of the bench) providing a useful ergonomic arrangement for the operator to rotate the wheel and feed a workpiece whilst face on to the front of the rolling mill. Further, in embodiments of the invention the axis of the input handle and the rollers are in different orientations and this may provide a more stable arrangement which is less prone to tip the rolling mill forward or back during operation. The worm-to-gear coupling of embodiments also positions the axis of the input shaft and operating handle relatively low on the rolling mill which may further increase stability during use.

Although the invention has been described above with reference to a preferred embodiment, it will be appreciated that various changes or modification may be made without departing from the scope of the invention as defined in the appended claims. For example, whilst in the illustrated example the gearbox 30 and roller coupling 213 are on opposite sides of the rolling mill it will be appreciated that in some embodiments they could be arranged on a single side of the mill (for example to allow additional rollers to be provided on the opposite side external to the frame).

Further whilst the gears in the second embodiment are simple spur gears other forms of gear such as helical gears could be used. Likewise the skilled person may also be aware of other gear train configurations which whilst more complex may also provide a high reduction ratio within the scope of the invention (for example the use of a planetary gear train).

The invention claimed is:

1. A hand-powered jewellery rolling mill comprising:

a support frame;

a pair of opposed parallel cylindrical rollers rotatably mounted to the support frame;

a drive shaft connected to at least one of the rollers for rotation thereof; and a manually rotatable handle for providing a drive force to the drive shaft; further comprising an input shaft, rotatable by the manually rotatable handle, the input shaft having a worm and wherein a worm-to-gear coupling transfers torque from the input shaft to the drive shaft, wherein the drive shaft is coaxial with one of the cylindrical rollers and a rotary coupling is provided between the drive shaft and an axle of the roller, and wherein the rotary coupling is a tongue and groove coupling formed in opposed radial faces of the drive shaft and the axle.

2. The rolling mill of claim 1, wherein:

the drive shaft is parallel to axes of the cylindrical rollers; and the input shaft is perpendicular to the drive shaft and extends forward of the drive shaft relative to a feed direction of the rolling mill.

3. The rolling mill of claim 2, wherein the drive shaft is parallel to a plane of a base of the support frame.

4. The rolling mill of claim 1, wherein the input shaft is offset below axes of the pair of opposed generally parallel cylindrical rollers.

5. The rolling mill of claim 1, wherein a gear of the worm-to-gear coupling is mounted on the drive shaft.

6. The rolling mill of claim 1, wherein the worm-to-gear coupling provides a single stage reduction.

7. The rolling mill of claim 6, wherein the worm-to-gear coupling provides a reduction ratio of greater than 10 to 1.

8. The rolling mill of claim 6, wherein the worm-to-gear coupling provides a reduction ratio of 40 to 1.

9. The rolling mill of claim 1, wherein the drive shaft is coupled to one of the pair of opposed parallel cylindrical rollers and the rolling mill further comprises a geared engagement between the pair of opposed parallel cylindrical rollers.

10. The rolling mill of claim 1, wherein the rolling mill further comprises an adjustor for setting a spacing between the rollers.

11. The rolling mill of claim 1, wherein the drive shaft, the input shaft and the worm-to-gear coupling are enclosed by a gearbox housing.

12. A hand-powered jewellery rolling mill comprising:

a support frame;

a pair of opposed parallel cylindrical rollers rotatably mounted to the support frame;

a drive shaft connected to at least one of the rollers for rotation thereof; and a manually rotatable handle for providing a drive force to the drive shaft; further comprising an input shaft, rotatable by the manually rotatable handle, the input shaft having a worm and wherein a worm-to-gear coupling transfers torque from the input shaft to the drive shaft, wherein the drive shaft, the input shaft and the worm-to-gear coupling are enclosed by a gearbox housing, and wherein the gearbox housing comprises:

a body adapted for attachment to the rolling mill;

a drive shaft bore extending through the body in a first direction; and an input shaft bore extending through the body in a second direction, perpendicular to the first direction; and wherein the drive shaft bore and the input shaft bore partially intersect to define a cavity for the worm-to-gear coupling.

13. The rolling mill of claim 12, wherein the drive shaft bore is a through bore and the gearbox housing further comprises a cover closing an external end of the bore.

14. The rolling mill of claim 12, wherein the input shaft bore is a blind bore and input shaft extends beyond an open end of the bore to provide a stem for the manually rotatable handle.

15. The rolling mill of claim 14, wherein the gearbox housing further comprises a flange surrounding the open end of the input shaft bore for receiving a bearing to support the input shaft.

16. The rolling mill of claim 12, wherein the gearbox housing, the drive shaft, the input shaft, the worm-to-gear coupling, and the manually rotatable handle are configured as a gearbox subassembly.

* * * * *